United States Patent [19]

Birrittella et al.

[11] Patent Number: 4,628,248

[45] Date of Patent: Dec. 9, 1986

[54] NPN BANDGAP VOLTAGE GENERATOR

[75] Inventors: Mark S. Birrittella; Robert R. Marley, both of Phoenix; Keith D. Nootbaar, Chandler, all of Ariz.

[73] Assignee: Motorola, Inc., Schaumburg, Ill.

[21] Appl. No.: 761,207

[22] Filed: Jul. 31, 1985

[51] Int. Cl.[4] ..... G05F 3/20

[52] U.S. Cl. ..... 323/314; 323/316; 323/907

[58] Field of Search ..... 323/312-316, 323/907; 307/296 R, 297, 310; 330/257, 288

[56] References Cited

U.S. PATENT DOCUMENTS

| | | | |
|---|---|---|---|
| 4,249,122 | 2/1981 | Widlar | 323/313 |
| 4,249,123 | 2/1981 | Kwan | 323/907 X |
| 4,313,083 | 1/1982 | Gilbert et al. | 323/313 X |
| 4,348,633 | 9/1982 | Davis | 323/314 |

*Primary Examiner*—Peter S. Wong
*Attorney, Agent, or Firm*—William E. Koch

[57] ABSTRACT

An all NPN bandgap voltage reference is provided that includes a Widlar type temperature coefficient compensation circuit. A pair of NPN differentially connected transistors maintain a constant current in the Widlar circuit over variations in power supply voltage $V_{EE}$ while causing an increase in current in the Widlar circuit as temperature increases for maintaining a constant output voltage.

15 Claims, 2 Drawing Figures

– PRIOR ART –

NPN BANDGAP VOLTAGE GENERATOR

BACKGROUND OF THE INVENTION

1. Field of the Invention

This invention relates, in general, to voltage generators and more particularly to an integrated circuit bandgap voltage reference circuit that provides a reference voltage ($V_{BB}$) and current source voltage ($V_{CS}$).

2. Background Art

Many types of bandgap voltage reference circuits are known in the art. Typically, an output voltage having substantially zero temperature coefficient is produced by summing two voltages having opposite temperature coefficients, i.e., one positive temperature coefficient and one negative temperature coefficient.

In general, the positive temperature coefficient is produced by using two transistors operated at different current densities as is well understood. By connecting a resistor in series with the emitter of the transistor that is operated at a smaller current density and then coupling the base of this transistor and the other end of the resistor across the base and emitter of the transistor operated at the higher current density produces a delta $V_{BE}$ voltage across the resistor that has a positive temperature coefficient. This positive temperature coefficient voltage is combined in series with the $V_{BE}$ of a third transistor which has a negative temperature coefficient in a manner to produce a composite voltage having a very low or zero temperature coefficient. These prior art voltage reference circuits are generally referred to as bandgap voltage references because the composite voltage is nearly equal to the bandgap voltage of silicon semiconductor material, i.e., approximately 1.2 volts. Typically, the two transistors of the bandgap cell are NPN devices with the first transistor having an emitter area that is ratioed with respect to the emitter area of the second transistor whereby the difference in the current density is established by maintaining the collector currents of the two transistors equal.

One particular previously known circuit as described in U.S. Pat. No. 3,617,859, which is described further in the Detailed Description of the Invention, comprises a Widlar circuit having two NPN transistors scaled as described above and having a positive temperature coefficient. These two NPN transistors drive the base of a third NPN transistor having a negative temperature coefficient. A PNP transistor shunts, and therefore controls, current through the third NPN transistor to compensate for variations in the voltage supply $V_{EE}$. However, use of a PNP transistor thusly presents difficulties as follows. There are three types of PNP devices that are generally available in high speed ECL bipolar technologies. These are the vertical/substrate PNP device, which utilizes no N+ buried layer as part of the base region, a similar PNP device which does utilize the N+ buried layer as part of the base region, and finally a lateral PNP device. Traditionally the first type of PNP device has been used effectively as the shunt transistor because of its high beta characteristics. However, the vertical dimensions of advanced processes (i.e., epitaxial thickness) have been reduced over time due to speed and packing density requirements. This tends to cause this type of PNP device to have a very high beta, which in turn, results in a susceptibility to low $V_{CEO}$ (collector-emitter voltage with the base open) breakdown and collector-emitter punch through shorting. This is due to variable epitaxial thickness and variable auto-doping during epitaxial growth. Hence, this type of vertical/-substrate PNP device has become unreliable in advanced high speed processes. By adding an N+ buried layer to this type of device, the beta is reduced to a typical value less than one. Thus, the second type of PNP device is unacceptable as a shunt device. The lateral PNP device arranged in a donut shaped layout configuration can produce a beta in the five to twenty range. However, this beta is highly variable over process due to poor epitaxial doping control and poor base width control. Also, these devices have poor current density capability (i.e., low current beta rolloff) due to the low base doping. Therefore, they need to be made very large to satisfy the current carrying requirements of a shunt device and require a large area on the chip.

Thus, practical low voltage bandgap reference circuits cannot be manufactured utilizing present day high speed, low voltage semiconductor processes because of the poor quality of the PNP transistors.

Hence, a need exists for a low voltage reference circuit for providing a bandgap reference voltage having excellent temperature performance, power supply rejection and load regulation that does not require a PNP transistor for controlling the current within the NPN transistor having a negative temperature coefficient.

SUMMARY OF THE INVENTION

Accordingly, it is an object of the present invention to provide an improved voltage reference circuit.

Another object of the present invention is to provide a voltage reference circuit that does not require a shunt PNP transistor.

In carrying out the above and other objects of the invention in one form, there is provided an improved voltage reference circuit having a first and a second transistor operated at different current densities for developing a first voltage having a positive temperature coefficient. A third transistor is coupled to the second transistor for developing a second voltage having a negative temperature coefficient, wherein the first and second voltages are combined to establish a temperature compensated voltage at an output. A circuit is coupled to the first, second, and third transistor for providing current thereto. A pair of differentially connected NPN transistors are coupled to the third transistor and the circuit for biasing the circuit.

The above and other objects, features, and advantages of the present invention will be better understood from the following detailed description taken in conjunction with the accompanying drawings.

DETAILED DESCRIPTION OF THE INVENTION

Figure 1:
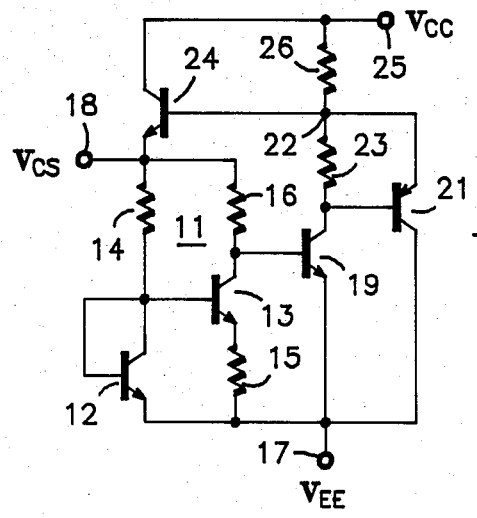
FIG. 1 is a schematic of a previously known voltage regulator circuit.

Referring to FIG. 1, a previously known circuit includes Widlar cell 11 comprising NPN transistors 12, 13 and 19, and resistors 14, 15, and 16. Transistor 12 has an emitter connected to supply voltage $V_{EE}$ terminal 17, and a collector connected both to its own base and the base of transistor 13 and coupled to current source voltage $V_{CS}$ output terminal 18 by resistor 14. Transistor 13 has an emitter coupled to terminal 17 by resistor 15 and a collector coupled to terminal 18 by resistor 16.

NPN transistor 19 has a base connected to the collector of transistor 13, an emitter connected to terminal 17 and a collector both connected to the base of PNP transistor 21 and coupled to node 22 by resistor 23. PNP transistor 21 has a collector connected to terminal 17 and an emitter connected to node 22. NPN transistor 24 has an emitter connected to terminal 18, a base connected to node 22 and a collector connected to supply voltage $V_{CC}$ terminal 25. Resistor 26 is coupled between terminal 25 and node 22. Typical voltages for supply voltages $V_{CC}$ and $V_{EE}$ are 0.0 volts and 5.0 volts, respectively; however, other voltages would suffice.

In operation, the currents sourced through resistors 14 and 16 from transistor 24 to the collectors of transistors 12 and 13 are set equal to one another such that transistors 12 and 13 are operated at different current densities due to first, resistors 14 and 16 being substantially equal and each ratioed larger than resistor 15, i.e., resistors 14 and 16 are M times resistor 15 (about eight times for instance), and second, transistor 13 having an emitter area which is ratioed with respect to the emitter area of transistor 12, i.e., the emitter area of transistor 13 is N times (about eight times for instance) the emitter area of transistor 12. Since transistor 13 has a lower current density than transistor 12, a voltage delta $V_{BE}$ is produced across resistor 15, and therefore a voltage M times delta $V_{BE}$ is produced across resistor 16, that has a positive temperature coefficient. The voltage between the base and emitter of transistor 19 has a negative temperature coefficient. A composite voltage is then produced at terminal 18 that has a substantially zero temperature coefficient. This regulated voltage is nearly equal to the bandgap voltage of the silicon semiconductor material.

The current through transistor 19 is controlled by shunt PNP transistor 21 and resistor 23. As supply voltage $V_{EE}$ varies, PNP transistor 21 shunts excess current from transistor 19. This maintains a current through transistor 19 almost independent of power supply voltage $V_{EE}$ variations and therefore prevents any change in the negative temperature coefficient component. However, difficulties arise in the fabrication of an integrated circuit having a vertical PNP transistor 21 for certain applications, i.e., memories, as previously discussed. A second consideration concerning the PNP device is the voltage tracking over temperature. The currents in transistors 12 and 13 increase with temperature. As temperature increases, the values of the circuit resistors increase, and the associated $V_{BE}$ of the circuit transistors decrease. The current in transistor 19 therefore decreases with increasing temperature, and therefore, the $V_{BE}$ of transistor 19 does not track with the $V_{BE}$ of transistor 12 over temperature. This causes a small mismatch of current densities between transistors 12 and 13. This inequality will cause the temperature coefficient associated with the regulated output voltage $V_{CS}$ to be less positive than if the current through transistor 19 were to increase with temperature.

Figure 2:
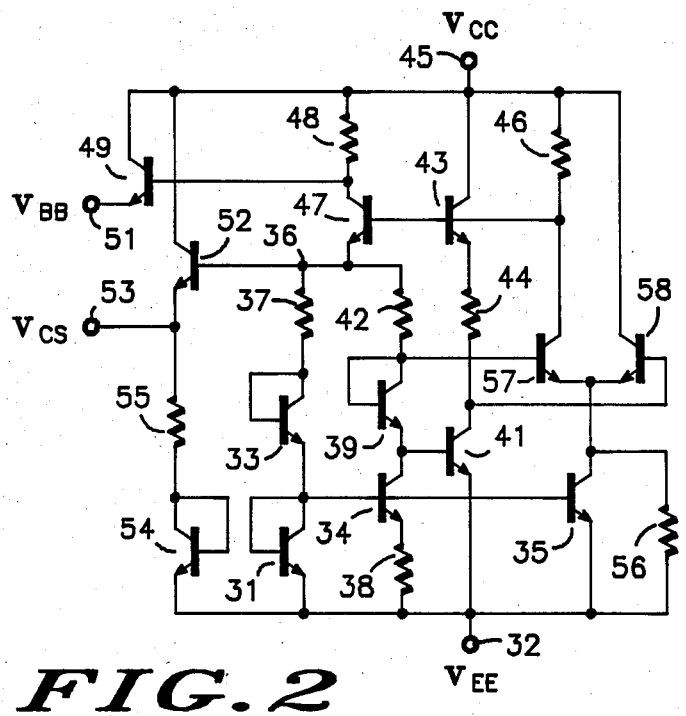
FIG. 2 is a schematic of the preferred embodiment of the present invention.

Referring to FIG. 2, the preferred embodiment of the present invention includes transistor 31 having an emitter coupled to supply voltage $V_{EE}$ terminal 32, and a base connected to its own collector, the emitter of transistor 33 and the bases of transistors 34 and 35. Transistor 33 is configured as a diode having its base and collector coupled to node 36 by resistor 37. Transistor 34 has an emitter coupled to terminal 32 by resistor 38, and a collector connected to the emitter of transistor 39 and the base of transistor 41. Transistor 39 is configured as a diode having its base and collector coupled to node 36 by resistor 42 and connected to the base of transistor 57. Transistor 41 has an emitter connected to terminal 32, and a collector coupled to the emitter of transistor 43 by resistor 44 and connected to the base of transistor 58.

The currents sourced through resistors 37 and 42 from transistor 47 to the collectors of transistors 31 and 34 are set equal to one another such that transistors 31 and 34 are operated at different current densities due to first, resistor 37 and 42 being substantially equal and each ratioed larger than resistor 38, i.e., resistors 37 and 42 are M times larger than resistor 42 (about eight times for instance), and second, transistor 34 having an emitter area which is ratioed with respect to the emitter area of transistor 31, i.e., the emitter area of transistor 34 is N times (about eight times for instance) the emitter area of transistor 31. Since transistor 34 has a lower current density than transistor 31, a voltage delta $V_{BE}$ is produced across resistor 38, and therefore M times delta $V_{BE}$ is produced across resistor 42, that has a positive temperature coefficient. The voltage between the base and emitter of transistor 41 has a negative temperature coefficient. A composite voltage is then produced at terminal 53 that has a substantially zero temperature coefficient. Transistors 33 and 39 function as diodes for setting the voltage level at the bases of transistors 57 and 58 sufficiently to allow insertion of current mirror transistor 35.

Transistor 43 has a collector connected to supply voltage $V_{CC}$ terminal 45, and a base coupled to terminal 45 by resistor 46 and connected to the base of transistor 47 and the collector of transistor 57. Transistor 47 has an emitter connected to node 36 and a collector coupled to terminal 45 by resistor 48 and connected to the base of transistor 49.

Transistor 49 has a collector connected to terminal 45 and an emitter connected to bias voltage $V_{BB}$ output terminal 51. Transistor 52 has a base connected to node 36, a collector connected to terminal 45, and an emitter connected to current source voltage $V_{CS}$ output terminal 53. Transistor 54 is configured as a diode having a base and collector coupled to terminal 53 by resistor 55, and an emitter connected to terminal 32.

Current mirror transistor 35 has an emitter connected to terminal 32, and a collector connected to the emitters of transistors 57 and 58, and regulates current to differential transistors 57 and 58. Transistor 58 has a collector connected to terminal 45. Resistor 56 is coupled between the collector of transistor 35 and terminal 32 for adjusting the overall temperature coefficient of transistor 35.

If supply voltage $V_{EE}$ on terminal 32 increases, the current through resistor 46 will increase, causing transistor 47, and therefore, transistor 57 to become more conductive. The voltage on the base of transistor 57 will increase and the voltage on the base of transistor 58 will decrease, causing transistor 57 to be more conductive and thereby sinking the increased current supplied by resistor 46. The current through transistor 35 will remain constant due to the current mirror effect of transistor 35. The current through transistor 58 will therefore decrease.

If the temperature increases, the voltage difference between the bases of transistors 57 and 58 is essentially unchanged due to the differential amplifier; therefore, the current through transistor 41 will track the current through both transistors 31 and 34, insuring a temperature compensated output voltage $V_{CS}$.

Transistor 49 provides an output voltage on terminal 51 which is constant over temperature variations and supply voltage $V_{EE}$ variations. The positive temperature coefficient of resistor 48 cancels the negative temperature coefficient of transistor 49. Variations in supply voltage $V_{EE}$ do not affect voltage $V_{BB}$ since the current through transistor 47 is maintained constant as described above.

By now it should be appreciated that there has been provided an improved all NPN voltage reference that maintains a constant output voltage regardless of changes in supply voltage $V_{EE}$ and temperature.

We claim:

1. A voltage reference circuit including a first output terminal for providing an output, a first supply voltage terminal, and a second supply voltage terminal, comprising:

first means for developing a first voltage having a positive temperature coefficient, comprising:

a first NPN transistor having an emitter coupled to said first output terminal, a collector coupled to said first supply voltage terminal, and a base;

second means coupled between said first output terminal and said second supply voltage means for providing a resistance;

a first resistor;

a second resistor;

a first diode;

a second diode;

third means for providing a resistance; and a second NPN transistor having an emitter coupled to said second supply voltage terminal by said first resistor, a base coupled both to said second supply voltage terminal by said first diode and to said base of said first NPN transistor by said third means, and a collector coupled to a node by said second diode, said node coupled to said base of said first NPN transistor by said second resistor;

fourth means coupled to said first means for developing a second voltage having a negative temperature coefficient, wherein said first and second voltages are combined to establish a temperature compensated voltage as an output;

fifth means coupled to said first and fourth means for sourcing current to both said first and fourth means; and sixth means coupled to said first and fourth means and responsive to said first and second voltages and coupled to said fifth means for biasing said fifth means.

2. The circuit according to claim 1 wherein said sixth means comprises a pair of differentially connected NPN transistors having their bases biased by said first and second voltages, respectively, and the collector of at least one of said differentially connected NPN transistors coupled to said fifth means.

3. The circuit according to claim 1 wherein said sixth means comprises:

a current mirror coupled to said second supply voltage terminal;

a third NPN transistor having an emitter coupled to said current mirror, a base coupled to said node, and a collector coupled to said first supply voltage terminal and said fifth means; and a fourth NPN transistor having an emitter coupled to said current mirror, a base coupled to said fourth means, and a collector coupled to said first supply voltage terminal.

4. The circuit according to claim 3 wherein said sixth means further comprises a third resistor coupled between said collector of said third NPN transistor and said first voltage supply terminal.

5. The circuit according to claim 1 wherein said fourth means comprises a fifth NPN transistor having an emitter coupled to said second supply voltage terminal, a collector coupled to said fifth, and a base coupled to said collector of said second transistor.

6. The circuit according to claim 1 wherein said fifth means comprises a sixth NPN transistor having an emitter coupled to said base of said first transistor, a collector coupled to said first supply voltage terminal, and a base coupled to said collector of said third NPN transistor.

7. The circuit according to claim 6 further comprising:

a second output terminal; and a seventh transistor having an emitter coupled to said second output terminal, a collector coupled to said first supply voltage terminal, and a base coupled to said collector of said sixth transistor.

8. The circuit according to claim 1 wherein said second means comprises:

a third diode coupled to said second supply voltage terminal; and a fourth resistor coupled between said third diode and said first output terminal.

9. The circuit according to claim 1 wherein said third means comprises:

a fourth diode coupled to the base of said second transistor; and a fifth resistor coupled between said fourth diode and said base of said first transistor.

10. An improved Widlar voltage reference circuit including a first supply voltage terminal, a second supply voltage terminal, first means coupled to a first output terminal for developing a first voltage having a positive temperature coefficient, second means coupled to said first means for developing a second voltage having a negative temperature coefficient, wherein said first and second voltages are combined to establish a temperature compensated voltage as an output at said first output terminal, wherein the improvement comprises:

third means for sourcing current to said first means comprising a first NPN transistor having an emitter coupled to said first means, a collector coupled to said first supply voltage terminal, and a base;

fourth means coupled to said second means for sourcing current to said second means; and fifth means coupled to said first and second means and responsive to said first and second voltages and coupled to said third and fourth means for biasing said third and fourth means.

11. The circuit according to claim 10 wherein said fifth means comprises a pair of differentially connected NPN transistors having their bases biased by said first and second voltages, respectively, and the collector of at least one of said differentially connected NPN transistors coupled to said third and fourth means.

12. The circuit according to claim 10 wherein said fifth means comprises:

a current mirror coupled to said second supply voltage terminal;

a second NPN transistor having an emitter coupled to said current mirror, a base coupled to said first means, and a collector coupled to both said first supply voltage terminal and said third and fourth means; and a third NPN transistor having an emitter coupled to said current mirror, a base coupled to said second means, and a collector coupled to said first supply voltage terminal.

13. The circuit according to claim 12 wherein said fifth means further comprises a first resistor coupled between said collector of said first NPN transistor and said first voltage supply terminal.

14. The circuit according to claim 12 wherein said fourth means comprises a fourth NPN transistor having an emitter coupled to said second means, a collector coupled to said first supply voltage terminal, and a base coupled to said collector of said second NPN transistor.

15. The circuit according to claim 14 further comprising:

a second output terminal; and a fifth NPN transistor having an emitter coupled to said second output terminal, a collector coupled to said first supply voltage terminal, and a base coupled to said collector of said third transistor.

* * * * *